US007197856B2

(12) United States Patent
Coles

(10) Patent No.: US 7,197,856 B2
(45) Date of Patent: Apr. 3, 2007

(54) MODULAR TRUSS ASSEMBLY

(76) Inventor: Ian Nicholas Coles, 1696 Walter St., Ventura, CA (US) 93003

( * ) Notice: Subject to any disclaimer, the term of this patent is extended or adjusted under 35 U.S.C. 154(b) by 0 days.

(21) Appl. No.: 10/654,750

(22) Filed: Sep. 3, 2003

(65) Prior Publication Data

US 2004/0123549 A1 Jul. 1, 2004

Related U.S. Application Data

(60) Provisional application No. 60/407,799, filed on Sep. 3, 2002.

(51) Int. Cl.
*E04C 3/02* (2006.01)
*E04H 12/00* (2006.01)

(52) U.S. Cl. ..... 52/638; 52/646; 52/652.1; 52/654.1; 52/693; 52/648.1

(58) Field of Classification Search ..... 52/633, 52/636–638, 645, 652.1, 654.1, 650.2, 653.1, 52/653.2, 655.1, 690, 693, 695, 648.1
See application file for complete search history.

(56) References Cited

U.S. PATENT DOCUMENTS

| | | | | | |
|---|---|---|---|---|---|
| 757,533 | A * | 4/1904 | Warner | 180/57 |
| 1,172,054 | A * | 2/1916 | Russell | 52/690 |
| 1,645,060 | A * | 10/1927 | Kraft | 52/634 |
| 2,360,433 | A * | 10/1944 | Magruder | 244/123.7 |
| 2,626,189 | A * | 1/1953 | Brown | 52/638 |
| 2,987,148 | A * | 6/1961 | Millard | 52/111 |
| 3,011,586 | A | 12/1961 | Harvey, Jr. | |
| 3,861,107 | A * | 1/1975 | Papayoti | 52/654.1 |
| 3,995,403 | A * | 12/1976 | Nickell | 52/284 |
| 4,557,876 | A * | 12/1985 | Nutter | 261/94 |
| 4,655,021 | A | 4/1987 | Franchin et al. | |
| 4,660,346 | A * | 4/1987 | Burger et al. | 52/653.1 |
| 4,793,113 | A * | 12/1988 | Bodnar | 52/481.1 |
| 4,949,516 | A * | 8/1990 | Long, Jr. | 52/645 |
| 5,301,486 | A * | 4/1994 | Taylor | 52/695 |
| 5,390,463 | A | 2/1995 | Sollner | |
| 5,437,135 | A * | 8/1995 | Witte | 52/693 |
| 5,484,634 | A | 1/1996 | Schutze | |
| 5,551,199 | A | 9/1996 | Hayes et al. | |
| 5,669,197 | A * | 9/1997 | Bodnar | 52/636 |
| 5,711,131 | A * | 1/1998 | Thomas | 52/656.9 |
| 5,927,036 | A * | 7/1999 | Matthews et al. | 52/483.1 |

(Continued)

FOREIGN PATENT DOCUMENTS

JP 6-287996 10/1994

*Primary Examiner*—Jeanette Chapman
(74) *Attorney, Agent, or Firm*—Jeffer, Mangels, Butler & Marmaro, LLP

(57) ABSTRACT

Truss assemblies of this invention comprise elongate chord elements having opposed first and second axial ends. Brace elements are used to orient and connect together the chord elements in a desired spatial orientation and have a plate structure. The brace elements comprise chord receiving openings disposed therethrough that are sized to accommodate placement of a respective chord element therein, and that are positioned to provide the desired spatial orientation between the chord elements. The chord element receiving openings and define a portion of the brace element that surrounds the chord element disposed within the opening. A connector is rotatably attached to an end of the chord elements to facilitate attaching the truss assemblies together for the purpose of forming a desired truss system.

29 Claims, 10 Drawing Sheets

U.S. PATENT DOCUMENTS 6,079,178 A * 6/2000 Fisher ..... 52/690
6,082,068 A * 7/2000 Fisher ..... 52/633
6,615,562 B2 * 9/2003 Fritsche et al. ..... 52/696
6,675,546 B2 * 1/2004 Coles ..... 52/655.1
6,854,219 B1 * 2/2005 Kelly et al. ..... 52/86
2002/0110406 A1 8/2002 Coles

* cited by examiner

MODULAR TRUSS ASSEMBLY

This application claims the benefit of U.S. Provisional Application No.: 60/407,799 filing date Sep. 3, 2002

FIELD OF THE INVENTION

The present invention relates generally to truss assemblies and, more particularly, to a modular truss assembly comprising independent truss assembly elements that are specially configured and assembled together to provide improved strength to self weight properties when compared to conventional truss assemblies.

BACKGROUND

Temporary and semi-permanent support and/or display structures are built for such events as rock band music tours, corporate displays at trade shows, set designs for movies, film and television productions, architectural center pieces and a variety of other uses such as for retail environments and displays, office or residential furniture pieces. The structures built for such events typically are assembled quickly for the particular event, to support lighting fixtures, display fixtures and the like, and are disassembled immediately after the event. Accordingly, the structures must be configured such that they can be assembled and disassembled quickly, easily and safely.

Depending on the particular venue, functional and aesthetic requirements will be identified for the structure to be constructed. The design parameters may further change during construction of the structure due to spatial considerations or the like. To accommodate the various functional and aesthetic requirements, the structures are generally built using a truss system that can be configured and engineered to adapt to a desired new design or orientation. Such truss systems are typically made up of a number of individual truss assemblies that are connected to one another in a particular fashion to form a rigid framework system. Such truss assemblies may be used to support a larger load or span a greater distance than can be accomplished effectively by a single beam or column.

Truss assemblies known in the art are typically formed from a number of metallic elements. Example, truss assemblies known in the art are formed from a number of metal chords that are connected together by a matrix of metal bracing or spanning members that are welded to the chords during the staging step of the assembly process. In many instances, the matrix of metal bracing is formed on-site by welding a number of differently configured metal pieces to the chords. This is both a time consuming and cost intensive process.

In many instances, the truss assemblies used to form the truss system are custom formed, having a particular size or shape, to provide the particular desired truss system structure. Thus, the exact number and configuration of the different truss assemblies that are formed to provide a particular truss system can and will vary depending on the particular truss system application.

An issue that exists with the above-noted conventional method of providing truss systems is the need to custom build custom intersections to enable the individual truss assemblies to be combined together in a desired manner for each different truss system application. This need for having a custom manufactured truss assembly element generally increases the cost and time associated with providing a desired truss system. This need also limits the ability of potentially being able to reuse the piece for different truss system applications, thereby resulting in a wasted or generally unusable truss assembly element once the truss system is dismantled, which is also not cost effective.

A further issue known to exist relates to the conventional method of building truss assemblies, e.g., from metallic elements, that provides a strength to self weight ratio that is somewhat limited, and that contributes to the overall weight of the truss assembly itself and the resulting truss system. In certain applications, the self weight of the truss assembly may become significant in relation to the load carrying capacity. This self weight may add to both the cost and time associated with transporting the truss assemblies and assembling the truss system.

It is, therefore, desirable that a truss assembly be constructed in a manner that provides an improved degree of flexibility in being able to produce a variety of differently configured truss system from a defined number of truss assemblies, thereby minimizing the cost and time associated with producing the same. Also, increasing the ability to reuse truss assemblies, thereby minimizing wasted stock and inventory. It is also desired the truss assemblies be constructed in a manner that provides improved strength to weight properties, thereby minimizing the cost and time associated with transporting and assembling the truss assemblies, and also enabling the use of truss assemblies for truss system applications not before thought possible.

SUMMARY OF THE INVENTION

Truss assemblies of this invention comprise an arrangement of elongate chord elements that each have opposed first and second axial ends. The chord elements can be formed from metallic or non-metallic materials, depending on particular truss assembly application. Brace elements are used to orient and connect together the chord elements in a desired spatial orientation. The brace elements can be formed from a metallic material, and can have a plate structure. The brace elements comprise a number of chord receiving openings disposed therethrough that are sized to accommodate placement of a respective chord element therein, and that are positioned to provide the desired spatial orientation between the chord elements. The chord element receiving openings define a portion of the brace element that surrounds a section the respective chord element disposed within the opening. A connector is rotatably attached to an end of the chord elements to facilitate attaching the truss assemblies together for the purpose of forming a desired truss system.

BRIEF DESCRIPTION OF THE DRAWINGS

Like numerals refer to like parts throughout the several views of the drawings.

DETAILED DESCRIPTION OF THE INVENTION

Modular truss assemblies, constructed in accordance with principles of this invention, are formed from a number of truss elements that are specially engineered to provide desired strength to weight improvements when compared to conventional truss assemblies. Truss assemblies of this invention each comprise a number of elongate chord elements held in spaced apart parallel arrangement from one another via one or more brace members provided in the form of base and intermediate elements. The chord elements can be formed from suitable metallic or non-metallic materials, and the brace elements can be provided in the form of a substantially flat plate to facilitate assembly of the truss assembly by sliding a desired section of the chord members through chord openings in the brace elements, and forming a permanent attachment therebetween.

Figure 1:
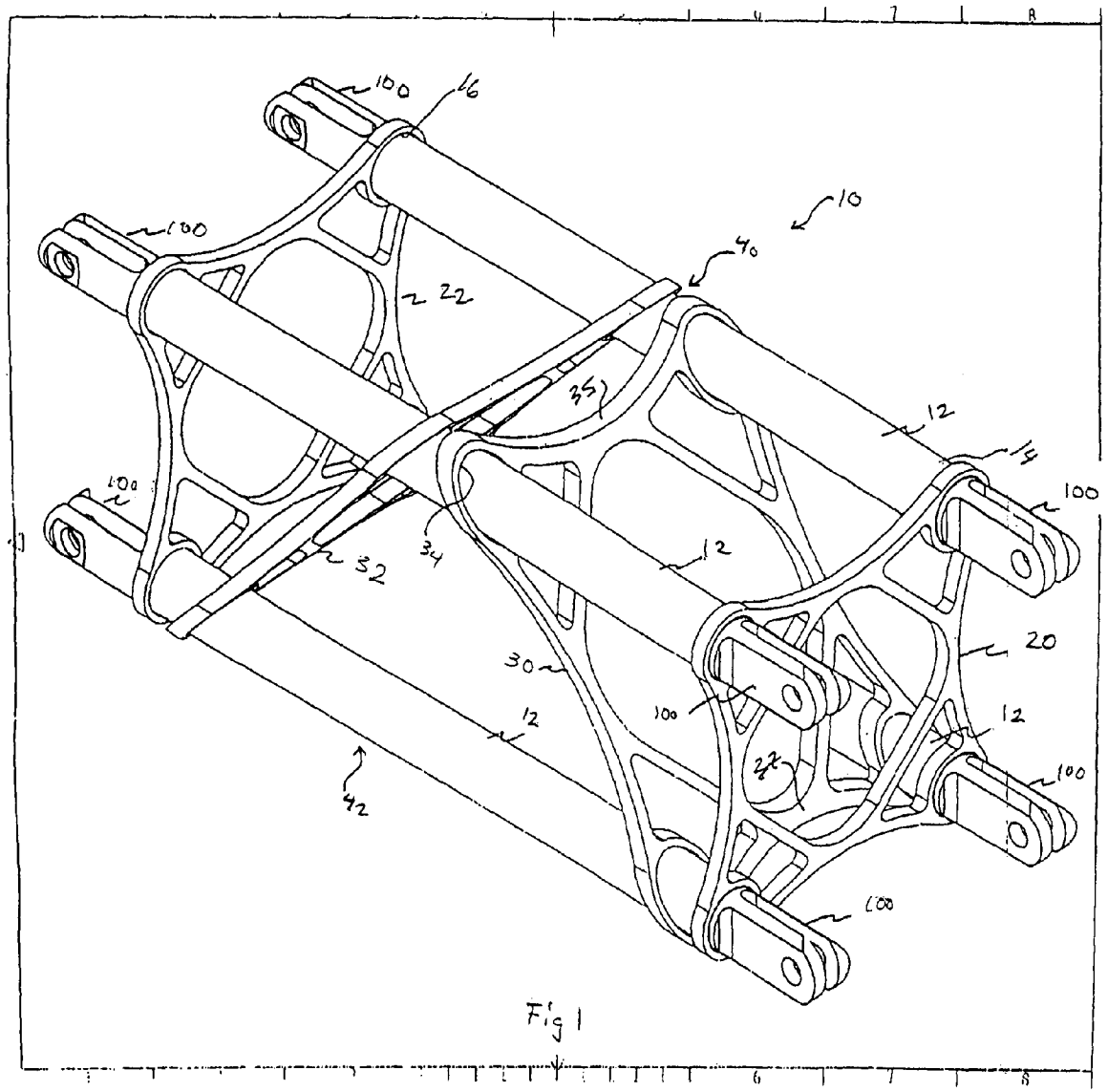
FIG. 1 is perspective view of an example truss assembly of the present invention.
Figure 2:
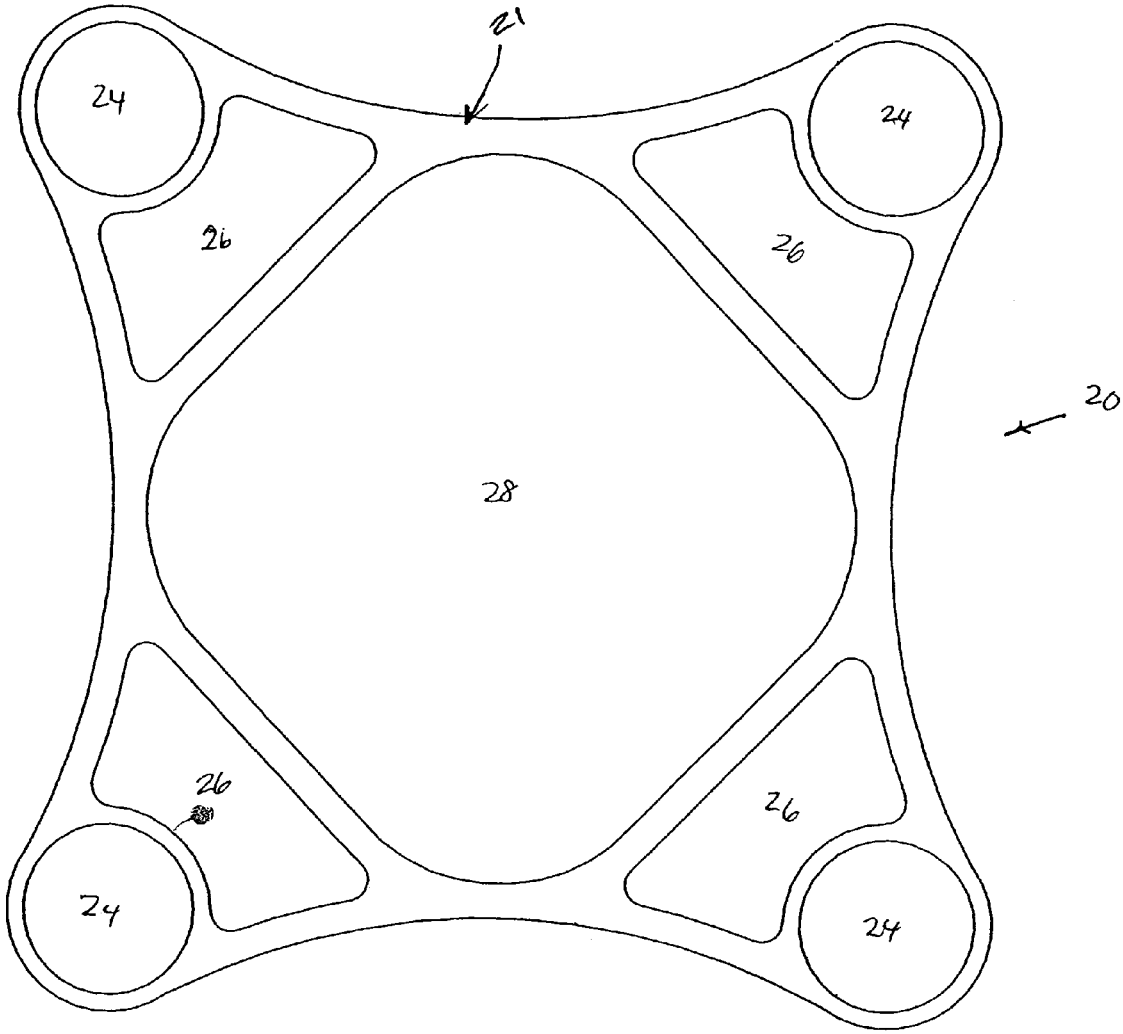
FIG. 2 is a top plan view of an example end plate from the truss assembly of FIG. 1.

As shown in FIG. 1, an example embodiment truss assembly 10 of the present invention includes a plurality of elongate chord elements or chords 12 connected to one another to form a rigid structural framework. In the example embodiment illustrated, the chord elements are provided having a tubular construction. However, it is envisioned that the chords can be configured having a number of different geometric shapes. While FIG. 2 illustrates a truss assembly 10 if this invention comprising four chord elements connected together to form a rectangular-shaped framework, it is within the scope of the invention to vary the number of chords used to form the truss assembly as desired to create a variety of different framework shapes, including circular frameworks, triangular frameworks and other polygonal-shaped frameworks. The chords preferably serve as a primary load support element of the truss assembly.

The material composition of the chords 12 depends upon the size and load requirements of the truss assembly or structure to be constructed. In an example embodiment of the invention, the chords 12 are preferably formed from a lightweight structural material selected from the group including metals, polymeric materials, fiber-resin composite materials, and/or a hybrid of such materials. It is to be understood that the material selected to form the chords can and will vary depending on the particular truss assembly application to meet the particular design requirements of the structure.

In a preferred embodiment, the chords are hollow and the wall thickness of the chords is understood to vary depending on the particular truss assembly application. In an example embodiment, the chords are formed from a carbon-fiber composite material. The chords have an outside diameter of approximately 25 mm, and a wall thickness of approximately 1.5 mm.

The chord elements 12 are connected to one another by two or more brace elements that are disposed between the chord elements. The brace elements serve to maintain a desired spatial relationship between the chords elements, and to provide a desired degree of bracing to avoid unwanted twisting and to add strength and structural support to the structure. In a preferred embodiment, the brace elements are configured in the form of end pieces and intermediate elements described in greater detail below.

The end pieces 20, 22 are positioned adjacent opposed axial ends of the chord elements. The exact placement of the end pieces near a respective chord axial end can vary. However, it is generally desired that the end piece be positioned within about 25 mm of a respective chord axial end for the purpose of providing structural support to the truss assemblies as close as possible to the point where the truss assemblies will be connected to one another, thereby adding structural support to the modular truss assembly formed therefrom.

In a preferred embodiment, the end pieces are provided in the form of a substantially flat plate, i.e., a structure having a minimal axial thickness, that is configured to accommodate placement of the chord elements therethrough to retain the same in a desired spaced apart orientation. The end pieces 20, 22 are preferably formed from a desired metallic or non-metallic structural material, such as those mentioned above for forming the chords, and the choice of material selected can and will vary depending on the strength and load carrying requirements of the application. In an example embodiment, the end pieces are formed from 6,000 series aluminum.

The end piece can be formed by machine or molding process, depending on such factors as the particular material selected for forming the end piece, and/or the particular end piece configuration. In a preferred embodiment, the end pieces are each provided in the form of a plate that is formed from a sliced cut of an aluminum extrusion. In a preferred embodiment, end pieces are formed by cutting the extrusion at a perpendicular angle.

As best shown in FIG. 2, the end pieces 20, 22 each have chord receiving openings 24 disposed axially therethrough that are positioned adjacent corner portions of the end pieces. The openings 24 are configured for receiving passage of a respective chord element 12 therethrough. The number of chord receiving openings 24 through the end pieces 20, 22 corresponds to the number of chords 12 used to form the truss assembly.

In the embodiment shown in FIG. 1, the truss assembly 10 includes four chords 12, and each end piece 20, 22 has four chord receiving openings 24. In the embodiment illustrated, the end piece 20 is positioned adjacent the axial end 14 of each of the chords, and the end piece 22 is positioned adjacent the opposite axial end 16 of each of the chords. The exact orientation of the end pieces 20, 22 within the truss assembly can vary. In a preferred embodiment, where the end pieces are formed from a perpendicular slice cut through an aluminum extrusion, the end piece extends in perpendicular or orthogonal fashion between the respective chord members to provide an equal level of support to each of the chord axial ends attached thereto.

The end pieces 20, 22 are shown having a substantially planar, rectangular shape. It is envisioned that, depending on the number of chords 12 and the desired size and shape of the truss assembly 10, the size and shape of the end pieces 20, 22 can vary and can include any round or polygonal shape. Ideally, the axial thickness of the end piece will vary depending on the particular truss assembly application.

However, for purposes of maximizing the strength to load carrying requirements of the truss assembly, it is generally desired that the thickness of end piece will be no greater than that needed to provide a desired degree of structural strength to the truss assembly.

The exact thickness of the end piece can vary depending on the compression and/or tension force that will be imposed upon it within the truss assembly. In an example embodiment, the thickness may range from about 6 mm to about 13 mm, with a preferred thickness being about 8 mm. Again, it is to be understood that the exact thickness of the end piece can and will vary depending on the truss assembly application.

In an example embodiment, wherein the truss assembly comprises the four chord elements described above, and wherein the end pieces are formed from a slice cut of extruded aluminum, the end pieces comprise four chord openings that are sized slightly larger in diameter than the respective chords. In such embodiment, the end piece chord openings are sized to accommodate placement of respective chords therein and facilitate the formation of a desired structural connection therebetween. In such an example embodiment, the gap between the a chord and a respective chord opening can be from 0.5 mm to 1.5 mm, the openings are spaced equally apart from another by approximately 125 mm, and the end piece has an axial thickness of approximately 6.5 mm.

As shown in FIG. 2, to further minimize the weight of the truss assembly to thereby increase the strength to self weight ratio of the truss assembly, the end pieces 20, 22 preferably comprise a number of removed or cored-out sections. The exact number and shape of the cored-out sections can be selected so that both the weight and strength requirements of the truss assembly are met. In an example embodiment, each end piece 20 is provided in the form of a continuous one-piece member having a webbed construction comprising outside peripheral section 21 that is defined along its corner sections by the chord receiving openings 24.

In addition to being sized and shaped to receive respective chords therethrough, the chord receiving openings 24 are configured to fit concentrically around the chords and protect the chords from potential damage from an external object, e.g., a floor surface. Since the chords are the primary structural members in the truss assembly for handling tension and compression loads, the ability to protect the chords from unwanted damage that could otherwise potentially impact the tension or compression carrying ability is highly desired.

In an example embodiment, a portion of the outside peripheral section 21 between each of the chord receiving opening 24 is concaved to projecting inwardly towards a center of the end piece. In such example embodiment, the end piece further comprises cored-out sections 26 positioned inwardly of the chord openings, and a centrally-positioned open or cored-out section 28. Again, it is to be understood that the exact size and configuration of the cored-out sections 26 and 28 of the end piece can and will vary depending on the eventually truss assembly application. Additionally, it is to be understood that the end plate may be configured to include only the chord openings, i.e., not have a cored-out configuration in applications where truss assembly weight savings is not a concern.

To provide additional anti-torsion and shear strength, the truss assembly 10 may include one or more intermediate elements 30, 32. The Intermediate elements 30, 32 can be constructed in a similar fashion to the end pieces 20, 22, e.g., be provided in the form of a substantially flat plate structure. The intermediate elements are positioned within the truss assembly in between the end pieces to both maintain the desired spatial orientation between the chords and to provide a desired degree of anti-torsion and shear strength to the truss assembly.

The intermediate elements can be formed from the same materials and in the same general manner as described above for the end pieces. Like the end pieces, the intermediate elements 30, 32 each have chord receiving openings 34 disposed therethrough that are positioned adjacent each corner section of the intermediate element, and that are sized to permit the passage of a respective chord element therethrough. The intermediate elements 30, 32 can also be configured in a manner that provides an improved strength to weight performance, by having a cored out design.

In a preferred embodiment, the intermediate elements are formed from an aluminum extrusion that is slice cut at a desired thickness to provide a web structure like that disclosed above for the end pieces. In such preferred embodiment, the intermediate elements are formed by slicing the extrusion at a diagonal or non-orthogonal angle, thereby providing chord opening that are oriented to receive respective chords therethough at an angle that is diagonal to the intermediate element.

In an example embodiment, the intermediate elements 30, 32 are configured to extend between the respective chords that pass therethrough in a non-orthogonal or diagonal fashion. This is in contrast to the end pieces that extend in a perpendicular or orthogonal fashion between respective chords. In a preferred embodiment, the intermediate elements 30, 32 are each configured so that they extend between a pair of opposed chords at an angle calculated to best provide a desired degree of stabilizing and strengthening performance. In an example embodiment, the intermediate elements are oriented between at least two opposed chord elements at an angle of between about 30 to 60 degrees, and more preferably at an angle of approximately 45 degrees.

In the event that truss assemblies of this invention are designed having more than one intermediate element, e.g., such as that illustrated in FIG. 1, it is desired that the intermediate elements be oriented with respect to one another in a manner that avoids any type of directional bias. For example, as illustrated in FIG. 1, the intermediate elements 30, 32 are oriented angularly within the truss assembly relative to two common opposed chord elements such that a top portion 35 of each intermediate element is directed towards one another, and a bottom portion 37 of each intermediate element is directed away from one another, e.g., forming an equilateral triangle with the pair of chords, with an apex 40 having sides extending to a base 42.

The chord receiving openings 34 of the intermediate elements 30, 32 are dimensioned such that the chords 12 can pass through the openings 34 regardless of the angular position of the intermediate plates 30, 32 with respect to the chords 12. In other words, the intermediate plates 30, 32 can be positioned at any angle with respect to the chords 12, including an orthogonal angle, an acute angle or an obtuse angle, and the chords 12 will still be able to pass through the chord receiving openings 34 of the intermediate plates 30, 32 in a manner that does not cause undesired binding or the like.

The method that can be used for connecting the intermediate and end pieces of the truss assembly to the chords depends on such factors as the permanency of the structure, the degree of support strength desired, and the types of materials used to form the chords and intermediate and end pieces. Each chord 12 is passed through a chord receiving opening 24, 34 in each of the end pieces 20, 22 and intermediate elements 30, 32. The chord may be attached to the end pieces 20, 22 and intermediate elements 30, 32 by spot or circumferential welding, by heat fusion, by adhesively gluing or bonding, and by using a mechanical connecting means such as a pin, screw or the like.

For semi-permanent and portable truss structure applications, the interconnection of truss assembly structural components may consist solely of properly molding or machining of the base and/or interconnect elements and chords to yield a frictional tight interference fit that may further be held in place by gravity or the weight of the structure.

In an example embodiment, where the chords are formed from a non-metallic material such as carbon fiber and the end pieces and intermediate elements are formed from aluminum, a suitable means for connecting the chords to the chord receiving openings comprises a adhesive bonding agent. In such embodiment it is desired that the chord receiving openings through the base and intermediate elements be sized to both permit passage of the chord element portion therethrough without damaging the same, while at the same time providing a desired annular void therebetween the provide a desired thickness of adhesive necessary for forming a permanent attachment. A preferred adhesive is a heat-cured two-part epoxy adhesive.

A desired feature of truss assemblies of this invention is the ability of being able to use non-metallic elements in constructing the same. For example, as described above, the chord elements can be formed from polymeric and/or fiber-resin composite materials. The ability to use materials other than traditional metals in forming truss assemblies of this invention enables truss assemblies of this invention to serve decorative and communicative functions in addition to structural functions.

For example, as mentioned above, in a preferred embodiment of the invention the chords are constructed from a carbon fiber-resin composite material. An example method for making the chords from carbon fiber comprises; wrapping a ribbon of carbon fiber around a suitably-sized mandrel, impregnating the ribbon of carbon fiber with a suitable resin such as an epoxy resin, placing the impregnated carbon fiber wrapped mandrel into an oven to achieve to heat cure the epoxy resin to the carbon fiber, remove the heat cured carbon fiber from the oven, and remove the heat cured carbon fiber chord from the mandrel.

From a functional standpoint, carbon fiber has a high strength to weight ratio, making it an ideal material for the construction of a truss assembly. From an aesthetic standpoint, such composite materials can be fabricated having a variety of differently designed outer woven fabric layers. Additionally, color finishes can be provided below the surface of the final transparent layer to provide a desired colored appearance to the truss assembly. Further, this topmost layer of fiber can be printed, giving the finished chord a faux effect such as wood or bamboo. Finally, writing, such as corporate logos or marketing messages, can be printed on the topmost layer of the composite according, e.g., to the method disclosed in U.S. Pat. No. 6,561,100, which is incorporated herein by reference. Thus, enabling truss assemblies of this invention to be used for advertising and marketing purposes.

In another example, the chords can be formed from a transparent or semi-transparent, optically transmissive or semi-transmissive, polymeric material, such as plexiglass. The ability to provide a truss assembly that is optically transmissive permits the truss to be used in a manner that is decorative in addition to structurally functional. If desired, lighting can be added to enable the truss assembly to function as a light source, and/or liquid or other materials can be placed inside of the chords to further add to its decorative and functional capability.

FIG. 1 depicts but one example truss assembly 10 of this present invention. The length and size of the truss assembly is understood to vary depending on the particular truss assembly application. Furthermore, additional intermediate and end pieces can be added to the truss assembly as needed to adjust the strength and/or aesthetic appearance of the truss assembly.

Figure 3:
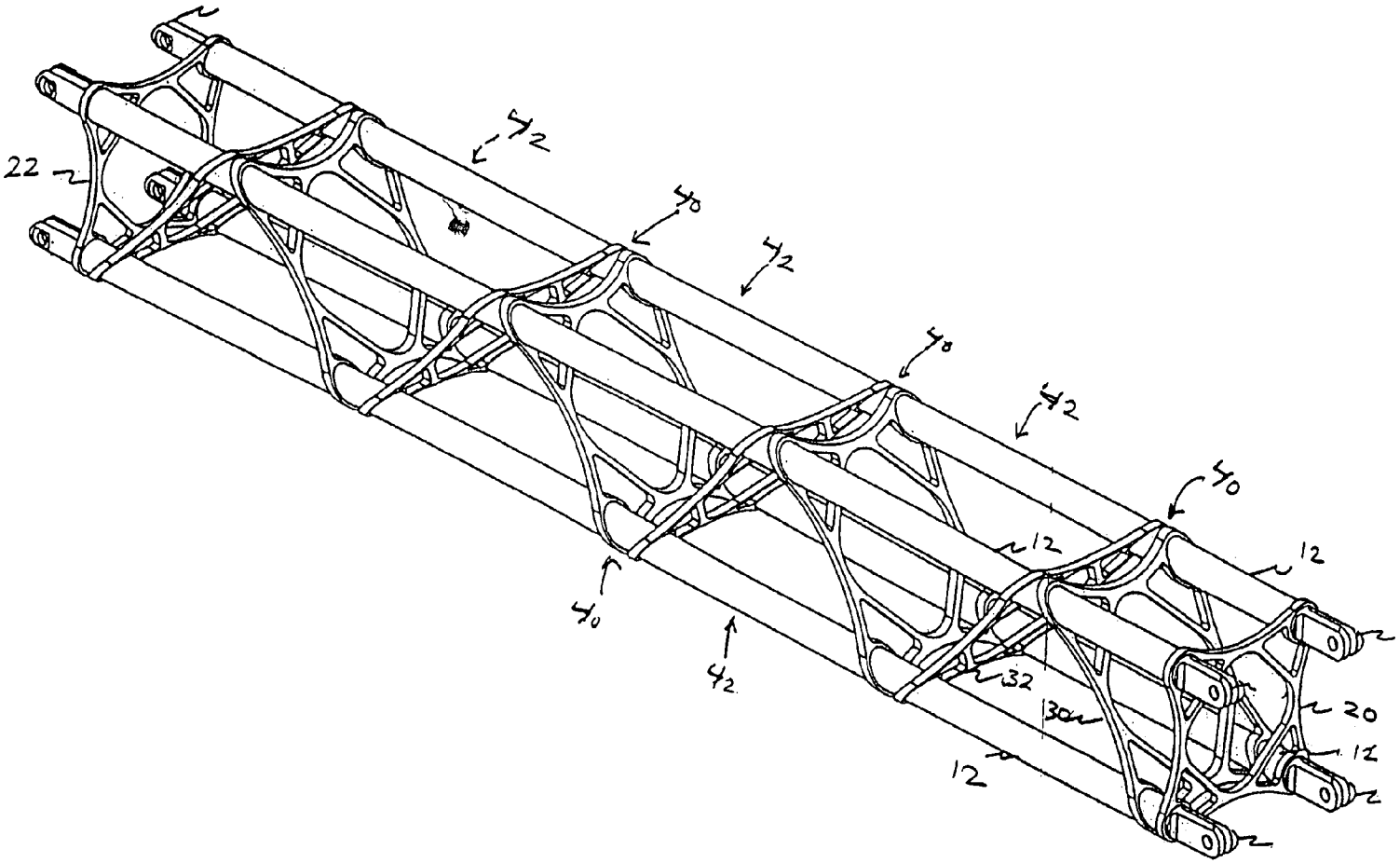
FIG. 3 is a perspective view of a length of an example truss assembly of this invention comprising several intermediate elements.

FIG. 3 shows another embodiment of the truss assembly 10 of this invention having an extended length and additional intermediate plates 30, 32, when compared to that illustrated in FIG. 1. This example illustrates how the intermediate plates can be oriented in one preferred embodiment having portions that deflect angularly away and towards one another to provide a triangular or V-shaped pattern of alternating apex 40 and base 42 configurations. It is, however, understood that the manner in which the intermediate plates are oriented within the truss assembly can vary depending on the particular truss assembly application. For example, one of more of the intermediate plates can be positioned at angles relative to the chords that are different from one another. Further, one or more of the intermediate plates can be positioned within the truss assembly at an angle that is orthogonal to the chords.

Truss assemblies of this invention can be provided having a variety of different lengths to meet different application requirements. For example, truss assemblies of this invention can be provided in lengths of from about 0.6 m to 3 m. In this particular example, the chord members are sized having a length of approximately 3 m.

Figure 4:
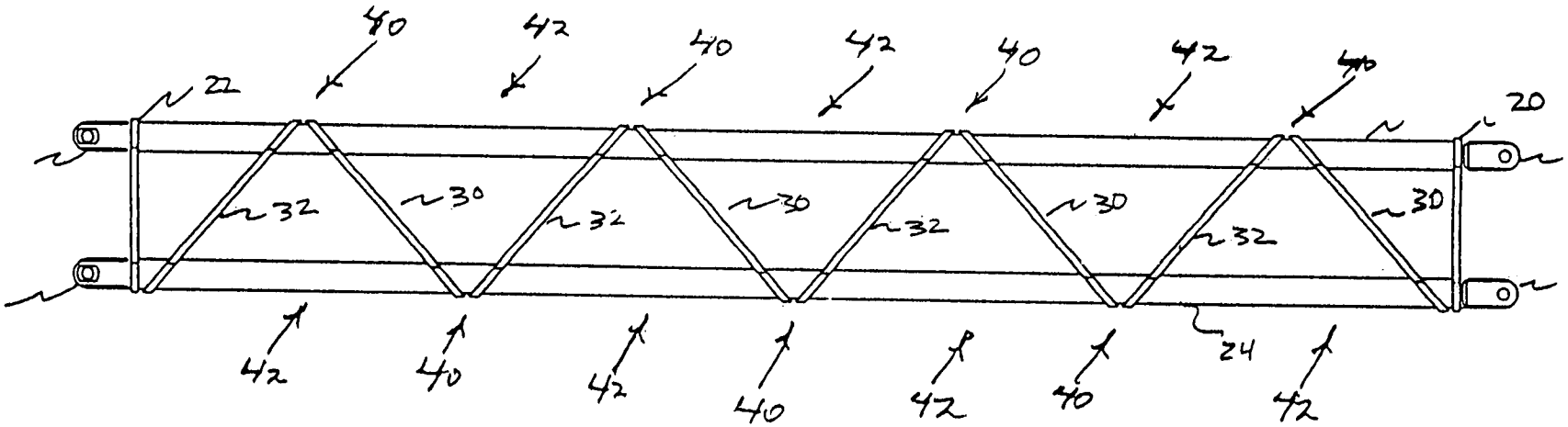
FIG. 4 is a side view of the truss assembly of FIG. 3.

FIG. 4 shows a side view of the truss assembly 10 illustrated in FIG. 3 that more clearly indicates the replicated intermediate plate interconnect structure, with triangle apexes 40 and bases 42, that operate to permit the structure to be conveniently formed in a multiplicity of lengths dependent on the need, portability, structural strength and specific application.

Figure 5:
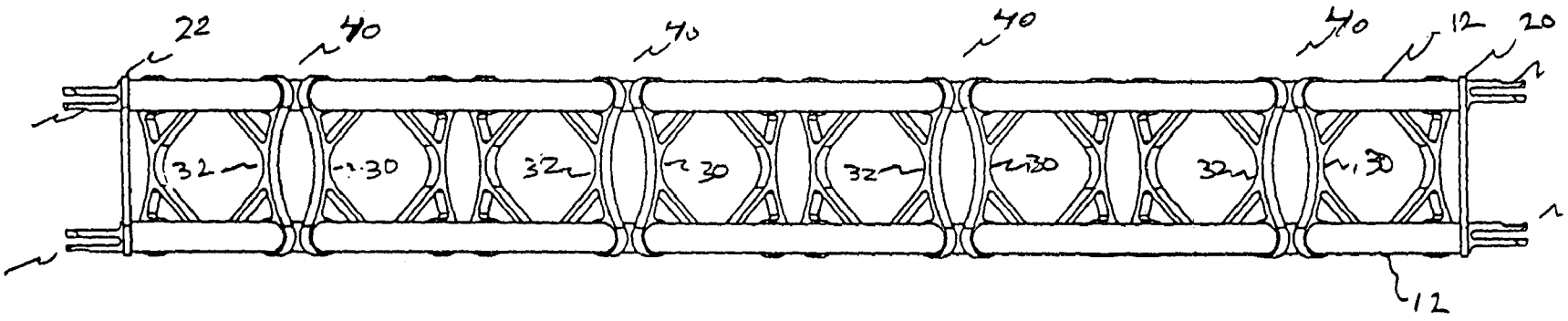
FIG. 5 is a top plan view of the truss assembly of FIG. 3.

FIG. 5 illustrates a top plan view of the truss assembly 10 illustrated in FIGS. 3 and 4 that clearly indicates the replication of the triangular apexes 40 of replicated intermediate plates 30 and 32 with the truss assembly terminating at either end with end pieces 20 and 22. While FIGS. 3 to 5 depict an example embodiment of the truss assembly comprising intermediate plates positioned in a certain manner, it is understood that the exact number of intermediate plates interposed between the end pieces can vary depending on the types of materials selected to form the chords and intermediate plates, and depending on the length and load carrying requirement of the truss assembly. For example, although the intermediate plates are shown almost touching one another at the apexes 40, they can be spaced apart from one another further than shown.

Figure 6:
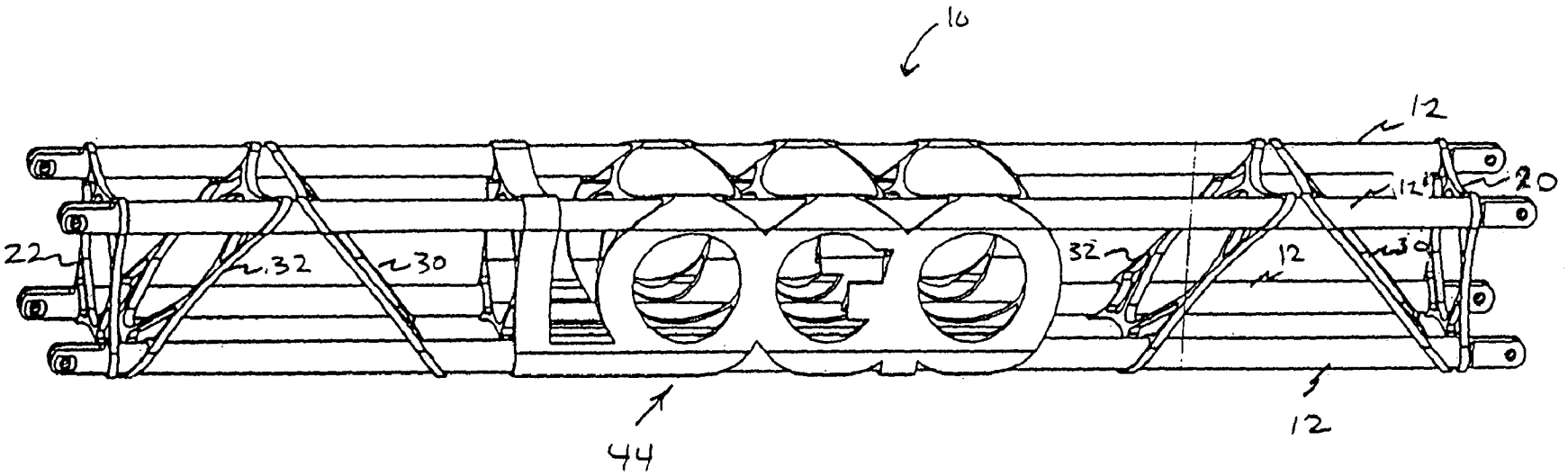
FIG. 6 is a perspective view of an alternate embodiment truss assembly having an intermediate element configured in the form of a logo.

FIG. 6 illustrates yet another embodiment of the truss assembly 10 of the present invention, wherein one or more of the intermediate plates 30 and 32 have been replaced by a three-dimensional member 44. The three-dimensional member 44 acts in a dual capacity as both an intermediate element, in the manner described above, and as a logo design or message emanating member, thereby enabling use of the truss assembly for communication purposes.

Figure 7:
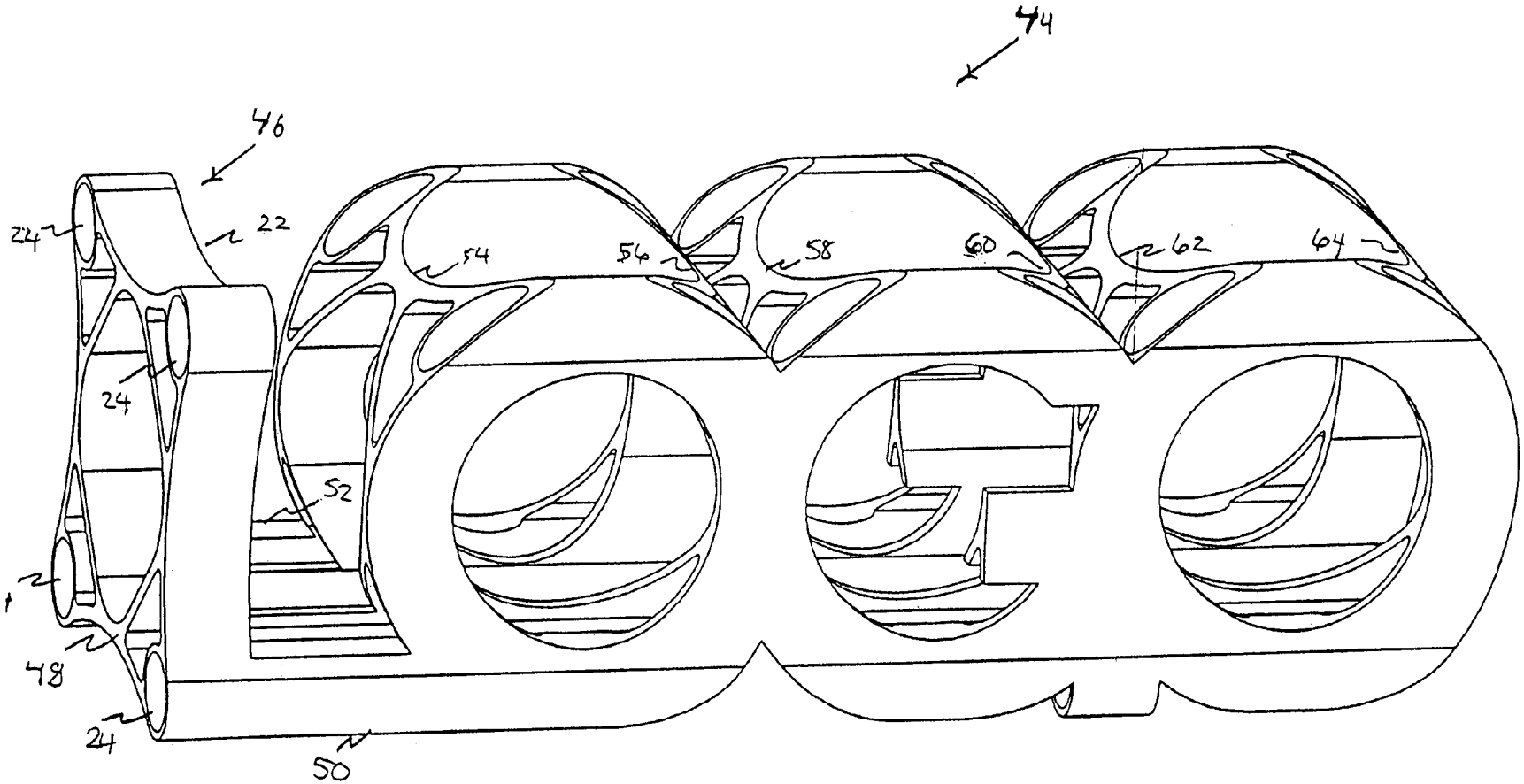
FIG. 7 is a perspective view of the logo portion of the intermediate element of FIG. 6.

FIG. 7 more clearly illustrates the three-dimensional member 44 from FIG. 6, wherein the "L" portion 46 of the member 44 can be seen to be composed of a thickened end piece 22 with respective chord receiving openings 24 for passage therethrough of chords 12, respectively. Combined or molded with a base of the "L" is a bridging support member 48 connecting a pair of chord receiving openings 24. In a similar manner, the "O" portion of the member 44 is molded with cross members 54, 56, the "G" portion is molded with cross members 58, 60, and the second "O" portion is molded with cross members 62, 64 to form not only a decorative readable slogan or logo but also to simultaneously serve as a cross member structural support for the chord members of the truss assembly. The three-dimensional member 44 can be formed from the same types of materials described above for forming the base and intermediate elements.

Figure 8:
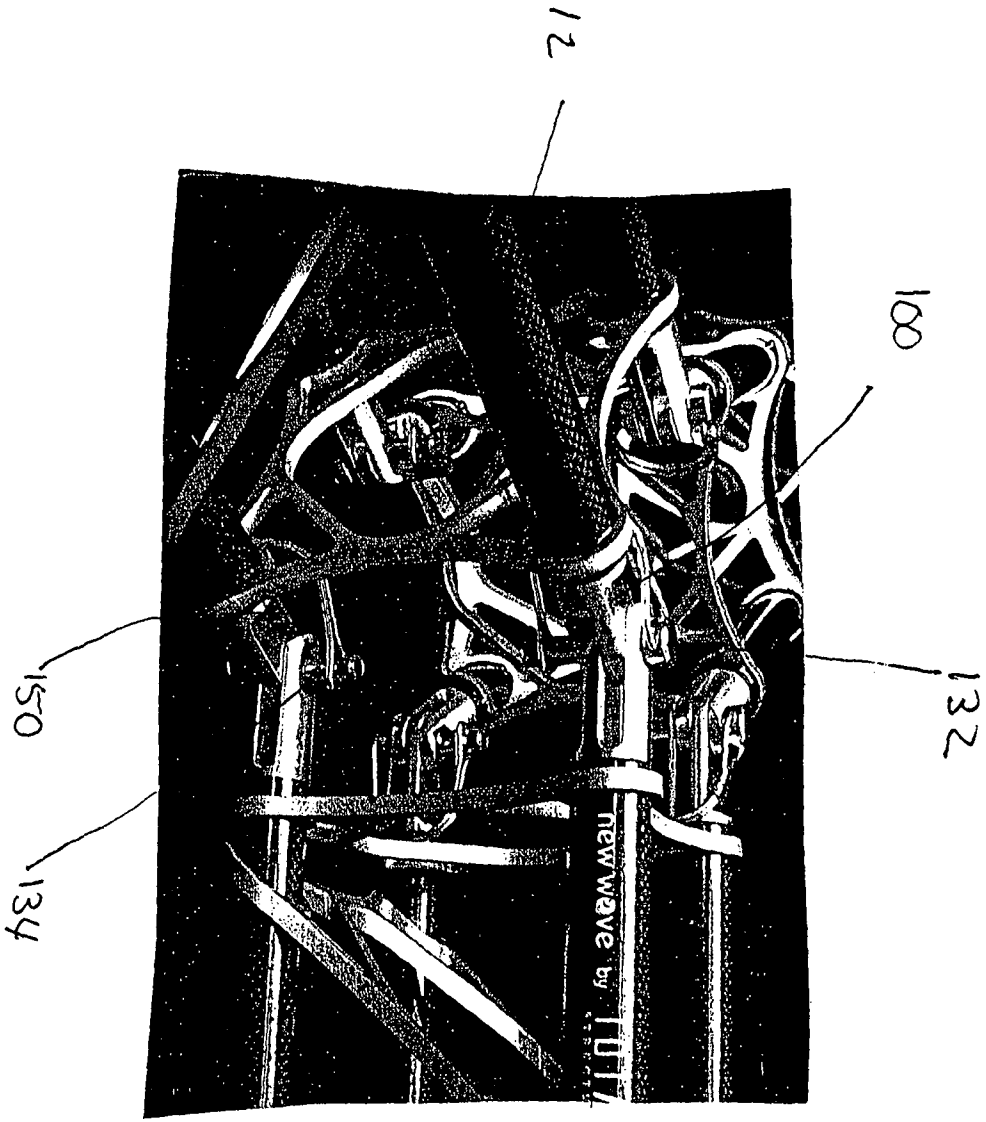
FIG. 8 is a perspective view of an example connection point between a number of truss assemblies.

FIG. 8 illustrates an example connection point between a number of truss assemblies 10 of this invention. In this particular example, three truss assemblies 10 are connected to one another. The number of truss assemblies of this invention than can be connected together in similar fashion is understood to vary depending on the particular truss assembly design and application. In an example embodiment, the truss assemblies are connected to one another via use of an omnidirectional connector 100 that is rotatably mounted at the end of each chord element 12. In a preferred embodiment, a connecting pin 130 or the like is used in conjunction with the omnidirectional connector 100 to removably join together interconnected omnidirectional connectors 100, thereby joining the truss assembly ends together.

Figure 9:
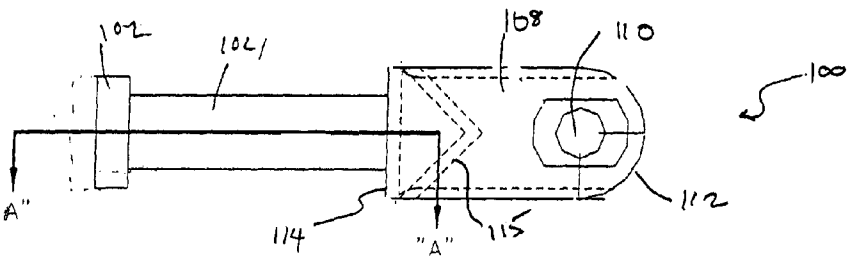
FIG. 9 is a top plan view of an example omnidirectional connector of the present invention.
Figure 10:
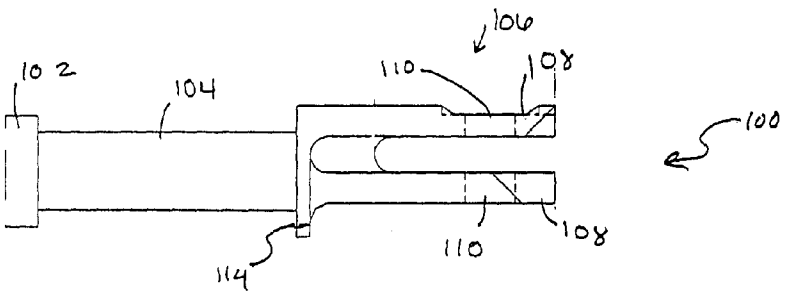
FIG. 10 is a side view of the omnidirectional connector of FIG. 9.

As shown in FIGS. 9 and 10, the omnidirectional connector 100 is configured to be rotatably mounted within an axial end of the truss assembly chord 12. It is preferred that the connector 100 be mounted within the chord end so that it does not loosen or tighten as it is rotated, thereby ensuring a desired connection integrity independent on how the connector is rotated. In an example embodiment, the omnidirectional connector 100 is formed from a suitable structural material, which can be metallic or non-metallic. Suitable metallic materials include stainless steel, brass, aluminum, and the like. In a preferred embodiment, the connector is machined from aluminum. The omnidirectional connector has a base 102, a shaft 104 and a mating end 106. The mating end 106 preferably has opposed fork members 108 extending therefrom that each having holes 110 disposed therethrough. In an example embodiment, the fork members 108 have rounded or arcuate ends 112 at one end, and a base stop 114 at an opposite end.

Figure 11:
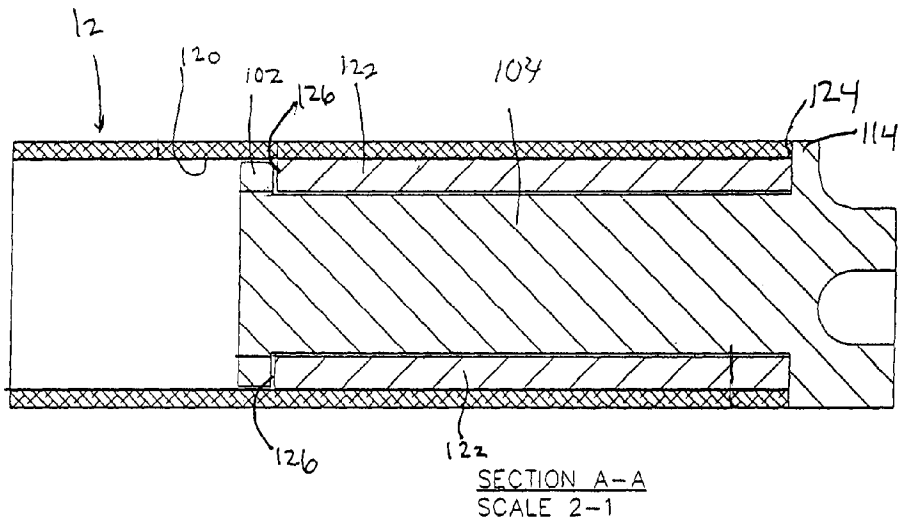
FIG. 11 is a side cross-sectional view of the omnidirectional connector of FIG. 10 installed in a chord element of the truss assembly.

The connector 100 is installed at each end of each chord 12, as shown in FIG. 1. FIG. 11 shows the manner in which the connector is installed in a chord 12. In a preferred embodiment of the invention, the chord 12 has an inside wall surface 120 and a positioning guide 122 attached thereto. The positioning guide can be formed from a metallic or non-metallic material. In an example embodiment, where the chord is formed from carbon fiber, the positioning guide 122 is also formed from carbon fiber. In such example, the positioning guide is attached to the inside wall surface by adhesive bonding, e.g., by positioning the positioning guide around the connector shaft 104, placing the adhesive bonding agent either along an outside surface of the positioning guide or the inside wall surface of the chord end, and inserting the connector shaft and positioning guide as an assembly into the chord end. The bonding agent that is used can be the same as that described above for bonding the chord elements to the base and intermediate elements.

The connector 100 is positioned in the chord 12 such that the base stop 114 contacts the end 124 of the chord 12, and the base 102 contacts the end 126 of the positioning guide 122. Because the connector 100 is not fixedly attached at any point to the chord 12, the connector 100 remains fully rotational within the chord. Therefore, while the axial movement of the connector 100 within the chord 12 is prevented by the positioning guide 122 and the chord end 124, the rotational movement of the connector 100 is completely unrestrained and the connector 100 is free to turn 360 degrees within the chord 12. The complete rotational freedom of the connector 100 allows truss assemblies of this invention to be attached to one another through a wide range connection angels, thereby maximizing potential available design configuration options.

Figure 12:
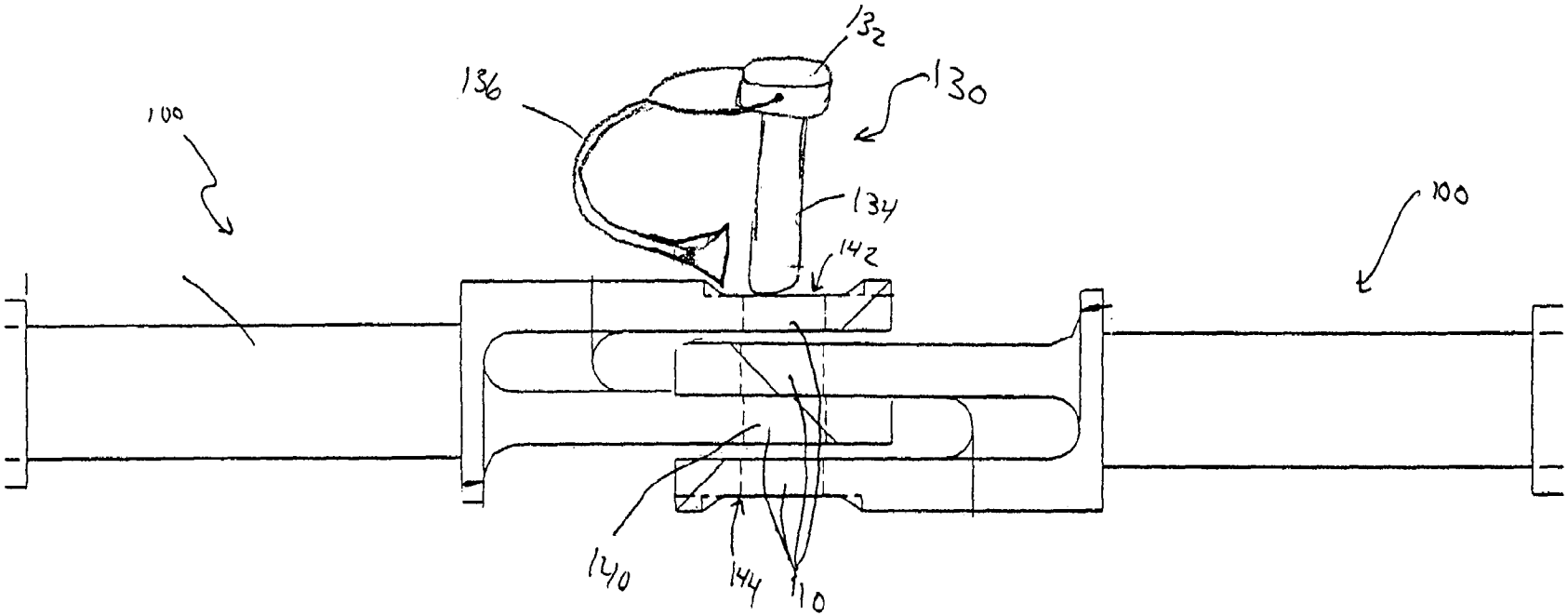
FIG. 12 is a side view of two omnidirectional connectors mated with each other and releasibly attached together via a connecting pin.

FIG. 12 illustrates an interconnection made between two omnidirectional connectors 100. The connectors are attached to one another by mating the connectors in a manner that aligns the holes 110 in the opposing forks 108 of each of the connectors with each other, forming a common passage 140 therebetween. When the holes 110 are aligned, a connecting pin 130 or the like is inserted through the passage 140 to hingedly attach the connectors 100 to each other. The pin 130 has a head 132, a shaft 134 and a locking arm 150. The head 132 of the pin 130 preferably has a larger diameter than the diameter of the holes 110 of the fork ends 108. The length of the shaft 134 is larger than the sum of the widths of the fork ends 108 such that the shaft 134 when inserted through the first end 142 of the passage 140 extends downward from the second end 144 of the passage 140.

The connecting pin 130 is locked into position by locking arm 150, as shown in FIG. 8. Locking arm 150 has a first end 152 and a second end 154. In a preferred embodiment of the invention, the first end 152 of the locking arm 150 is hingedly attached to the head 132 of the pin 130. In the embodiment shown in FIG. 8, the first end 152 of the locking arm 150 passes through an opening 136 in the pin head 132. The second end 154 of the locking arm 150 preferably has an opening 156 for receiving the shaft 134. The opening 156 is preferably dimensioned to securely receive the pin shaft 134 therein. In a preferred embodiment of the invention, the locking arm 150 is biased in a closed position in a manner that retains the position of the second end 154 of the locking arm 150 engaged with the pin shaft 134.

When connected with one another in the manner described above, the omnidirectional connector operates to provide a both 360 degree rotatable attachment option and a 270 degree pivoting attachment option. As shown in FIG. 9, the connector includes a base 115 disposed between the two opposed fork members 108 that operates to limit the degree to which another connector attached thereto can pivot relative to the connector. In an example embodiment, the base 115 is defined by two outwardly projecting walls (looking into the connector from ends of the fork members) that are each oriented at opposed 45 degree angles. Thus, two connectors attached together can theoretically pivot 270 degree about one another via the pin shaft noted above. However, when the connectors are attached to ends of the truss assembly the actual amount of pivoting movement relative to one another will be limited by interaction between other portions of the connected truss assemblies.

A feature of truss assemblies of this invention is that they can be easily constructed from a small number of basic elements; namely the chord elements, end pieces, intermediate elements, and connectors, thereby reducing the cost associated with manufacturing and assembling the same. Another feature is that the elements are produced from materials having an improved strength to self weight ratio when compared to conventional truss assemblies. A further feature is that the truss assemblies can be formed from elements that provide a decorative and/or communicative function.

When compared to conventional truss assemblies of equal length, truss assemblies of this invention provide defined improvements in strength to weight ratio. In an example embodiment, where the truss assembly comprises chords formed from carbon fiber and brace elements formed from aluminum and the truss member is approximately 6 m long, such truss assembly is about 4 times stronger than a conventional truss that is formed from aluminum.

The embodiments described above are exemplary embodiments modular truss assemblies of this invention, and module truss assemblies formed by connecting a number of the truss assemblies together. Although limited embodiments of modular truss assemblies and assemblies of this invention have been described herein, many modifications and variations will be apparent to those skilled in the art. Accordingly, it is to be understood that, within the scope of the appended claims, modular truss assemblies and assemblies of this invention may be constructed other than as specifically described herein.

What is claimed is:

1. A truss assembly comprising:

a number of elongate chord elements each having opposed first and second axial ends; and two or more brace elements connected to the chord elements, each brace element having a number of chord receiving openings disposed axially therethrough and positioned to provide a desired spatial orientation between the chord elements, wherein a section of each chord is disposed through a respective opening and each opening includes an inside wall surface that is oriented parallel to and that surrounds an outer surface of the chord that is disposed therein, wherein the chord elements are oriented within the truss assembly parallel with one another, wherein one brace element is positioned orthogonally within the truss assembly relative to the chord elements, and another brace element is positioned nonorthogonally within the truss assembly relative to the chord elements.

2. The truss assembly as recited in claim 1 wherein the brace elements comprise:

a pair of end pieces that are each positioned adjacent an end portion of the elongate chord elements; and at least one intermediate element that is interposed between the pair of end pieces.

3. The truss assembly as recited in claim 2 wherein the end pieces are provided in the form of a substantially flat plate that extends between the chord elements orthogonally and has an outside edge surface that is parallel with the chord elements.

4. The truss assembly as recited in claim 2 wherein the intermediate element is provided in the form of a substantially flat plate that extends between at least two chord elements nonorthogonally and has an outside edge that is parallel with the chord elements.

5. The truss assembly as recited in claim 1 wherein the brace elements are connected to the chord elements by means selected from the group consisting of mechanical attachment, adhesive attachment, and welding attachment.

6. The truss assembly as recited in claim 1 further comprising a connector rotatably mounted to an end of the chord elements and comprising an attachment end configured to provide a hinged attachment with another connector.

7. The truss assembly as recited in claim 1 wherein the chord elements are formed from a non-metallic material.

8. A truss assembly comprising:

a number of elongate chord elements each having opposed first and second axial ends;

a number of brace elements connected to the chord elements each having a number of openings disposed therethrough, wherein the chord elements are disposed within a respective opening that concentrically surrounds an outside surface of the respective chord element for receiving a section of each respective chord element, the openings being configured to spatially orient the chord elements in parallel with one another, the brace elements comprising:

an end piece positioned adjacent one or both of the chord element first and second axial ends; and an intermediate element positioned a distance away from the end piece between the chord element first and second axial ends, wherein each of the brace elements are provided in the form of a web construction cut from a brace member having the openings disposed therethrough, wherein the end piece is cut from the brace member in an orthogonal direction, and wherein the intermediate element is cut from the brace member in a non-orthogonal direction.

9. The truss assembly as recited in claim 8 comprising a pair of end pieces that are positioned adjacent each chord element first and second axial end, each end piece extending between the chord elements in an orthogonal direction relative to the chord elements.

10. The truss assembly as recited in claim 8 wherein the intermediate element extends between the chord elements in a non-orthogonal direction relative to at least two chord elements.

11. The truss assembly as recited in claim 9 comprising a number of intermediate elements interposed between the end pieces, the intermediate elements each extending between the chord elements in a non-orthogonal direction relative to at least two chord elements.

12. The truss assembly as recited in claim 11 wherein the brace elements are each in the form of a substantially flat plate.

13. The truss assembly as recited in claim 8 further comprising a connector rotatably mounted to one or both of the first and second axial ends of the chord elements, the connector comprising an attachment end configured to provide a hinged attachment with another connector.

14. The truss assembly as recited in claim 13 wherein the connector is configured to rotate 360 degrees relative to the chord element without becoming loosened therefrom.

15. The truss assembly as recited in claim 8 wherein the brace elements are connected to the chord elements by means selected from the group consisting of mechanical attachment, adhesive attachment, and welding attachment.

16. The truss assembly as recited in claim 8 wherein the chord elements are formed from a non-metallic material, and wherein the brace elements are adhesively bonded to the chord elements.

17. The truss assembly as recited in claim 16 wherein the brace elements are formed from a metallic material.

18. The truss assembly as recited in claim 16 wherein the chord elements are formed from polymeric materials, fiber-resin composite materials, and combinations thereof.

19. A modular truss system comprising a number of truss assemblies as recited in claim 13 that are removably coupled with one another by the connectors.

20. A truss assembly comprising:

a number of elongate chord elements each having opposed if first and second axial ends;

a number of brace elements connected to the chord elements, each brace element being in the form of a substantially flat plate and having a number of openings disposed therethrough for receiving a section of each respective chord element, the openings being configured to spatially orient the chord elements in parallel with one another and having an inside surface that surrounds an outside surface of respective chords that are disposed therein, the brace elements each having a continuous web construction formed from a cut section of a brace member and comprising:

a pair of end pieces each being positioned adjacent each chord element first and second axial ends, and each extending between the chord elements in an orthogonal direction relative to the chord elements, the end pieces being cut in direction orthogonal to the brace member; and a number of intermediate elements interposed between the pair of end pieces, and each extending in a non-orthogonal direction relative to at least two chord elements, the intermediate elements being cut in a non-orthogonal direction to the brace member.

21. The truss assembly as recited in claim 20 further comprising a connector rotatably mounted to one or both of the first and second axial ends of the chord elements, the connector comprising an attachment end configured to provide a hinged attachment with another identical connector.

22. The truss assembly as recited in claim 20 wherein the connector is configured to rotate 360 degrees relative to the chord element without becoming loosened therefrom.

23. The truss assembly as recited in claim 20 wherein the intermediate elements are positioned relative to one another to provide a repeated V-shaped arrangement.

24. The truss assembly as recited in claim 20 wherein the brace elements comprise a continuous web structure.

25. The truss assembly as recited in claim 20 wherein the chord elements are made from a non-metallic material, at least one of the brace elements are formed from a metallic material, and the chord elements are connected to the brace elements by adhesive bonding.

26. A truss assembly comprising:

a number of hollow elongate chord elements each having opposed first and second axial ends;

a connector rotatably mounted to one or both of the first and second axial ends of the chord elements, the connector comprising an attachment end configured to provide a hinged attachment with another connector;

a number of brace elements connected to the chord elements, each brace element being in the form of a substantially flat plate having a continuous web structure, the brace elements having an outside edge surface that is parallel to the chord elements and including a number of openings disposed therethrough for receiving a section of each respective chord element therethrough, the openings defining a portion of the brace element that completely surrounds a portion of each respective chord element and that include an inside wall surface that is oriented parallel to an adjacent outside surface of a respective chord element disposed therein, the openings being configured to spatially orient the chord elements in parallel with one another, the brace elements comprising:

a pair of end pieces each being positioned adjacent each chord element first and second axial ends, each extending between the chord elements in an orthogonal direction relative to the chord elements, and each being formed from a section of a brace member cut in an orthogonal direction to the brace member; and a number of intermediate elements interposed between the pair of end pieces, each extending in a non-orthogonal direction relative to at least two chord elements to form a repeating V-shaped arrangement of intermediate elements, and each being formed from a section of a brace member cut in a non-orthogonal direction to the brace member.

27. The truss assembly as recited in claim 26 wherein the brace elements comprise a web structure having a major portion that is defined by open area.

28. The truss assembly as recited in claim 26 wherein the chord elements are formed from a non-metallic material, and the brace elements are formed from a metallic material.

29. A method of making a truss assembly comprising the steps of:

forming an elongate brace member having a number of chord receiving openings disposed axially therethrough positioned to provide a desired spatial orientation between a number of elongate chord elements when a section of each chord is disposed through a respective chord receiving opening, wherein the chord receiving openings have a wall surface that is oriented parallel with an outside chord surface;

cutting a section of the brace member in a direction orthogonal to the brace member to form an end element that is positioned adjacent an axial end of the chord members; and cutting a section of the brace member in a direction non-orthogonal to the brace member to form an intermediate element that is interposed between axial ends of the chord members;

wherein the combined end element, intermediate element, and chord members form a truss assembly, and wherein the chord members are oriented within the truss assembly parallel with one another.

* * * * *